US005261727A

United States Patent [19]

Klaebel

[11] Patent Number: 5,261,727

[45] Date of Patent: Nov. 16, 1993

[54] CONVERTIBLE CHAIR

[75] Inventor: Walther Klaebel, LumsÅs, Denmark

[73] Assignee: Space International ApS, Frederiksberg, Denmark

[21] Appl. No.: 867,713

[22] PCT Filed: Jan. 10, 1991

[86] PCT No.: PCT/DK91/00007

§ 371 Date: Jul. 9, 1992

§ 102(e) Date: Jul. 9, 1992

[87] PCT Pub. No.: WO91/10384

PCT Pub. Date: Jul. 25, 1991

[30] Foreign Application Priority Data

Jan. 10, 1990 [DK] Denmark ..... 70/90

[51] Int. Cl.[5] ..... A47C 1/032

[52] U.S. Cl. ..... 297/423.13; 297/316; 297/319

[58] Field of Search ..... 297/423, 319, 316, 325

[56] References Cited

U.S. PATENT DOCUMENTS

| | | | |
|---|---|---|---|
| 2,471,024 | 5/1949 | Cramer | 297/319 X |
| 4,629,249 | 12/1986 | Yamaguchi | 297/319 X |
| 4,650,249 | 3/1987 | Serber . | |
| 4,736,982 | 4/1988 | Hwang . | |
| 4,765,684 | 8/1988 | Kvalheim et al. . | |
| 4,793,655 | 12/1988 | Kvalheim et al. . | |
| 4,834,454 | 5/1989 | Dicks | 297/319 X |
| 5,054,857 | 10/1991 | Kvalheim | 297/423 |

*Primary Examiner*—Michael F. Trettel

*Attorney, Agent, or Firm*—Wegner, Cantor, Mueller & Player

[57] ABSTRACT

The chair can be converted from a state where a person traditionally sits on the approximately horizontal seat (13) of the chair to another state where the person sits on the now inclined seat of the chair, one and the same means being used as back rest in one state and as knee rest in another state. The combined back and knee rest is arranged on one end of a two-armed lever (16) on whose other end there is provided a shaft (18) which is movable in a U-shaped guide (19) in firm connection with the seat. This ensures simple and rapid conversion of the chair between its two states.

20 Claims, 4 Drawing Sheets

CONVERTIBLE CHAIR

The invention concerns a chair as defined in the introductory portion of claim 1, i.e. a chair which can be converted from one state where a person can traditionally sit on the approximately horizontal seat of the chair, to another state where the person can sit on the now inclined seat of the chair, one and the same means being used as a back rest in said one state and as a knee rest in said other state.

Such a convertible chair is known e.g. from the U.S. Pat. No. 4 793 655. To lock the movable part of this chair in the traditional state with approximately horizontal seat and with back rest, there is in one embodiment provided a hook below the seat, and to convert the chair to the other state with inclined seat and with knee rest some dexterity must be exercised to find and to release the hook, and the person must moreover bend to be able to see the hook below the seat. In the other state of said chair with inclined seat and with knee rest, the seat and the knee rest are not locked in this state, which is therefore unstable. The chair therefore involves the risk that the seat and the knee rest will tilt in case of certain loads with unfortunate consequences for the seated person. In another embodiment a toothed rack is journalled to the bottom of the seat and extends into the supporting column. The arm of the back rest carries a pinion engaging the rack so that a vertical movement of the rack effects a pivoting of the arm with the back rest. The rack may be locked in various different vertical positions by a short rack member which is mounted in the supporting column and carries a knob. When the chair is to be converted the user may disengage the rack member by pulling in the knob whereafter the rack may be displaced to the new setting position. This chair is very difficult to convert because the knob is positioned below the seat and near the floor so that the user of the chair will have to bend down or kneel on the floor in order to pull the knob. Further, there is no means for determining the correct position of the back rest. Consequently, the user may either have to adjust the chair several times at each conversion or have to accept a somewhat wrong sitting position which impairs the ergonomical advantages of the convertible chair.

The U.S. Pat. No. 4 736 982 discloses a convertible chair where a transverse rod on a two-armed lever, which carries the back/knee rest, is to be positioned in a specific gap between downwardly facing teeth on an open rack on the lower side of the seat. The conversion is difficult to perform and involves some uncertainty, and great care is to be exercised in practice to localize the rod in precisely the tooth gap giving the desired angular position between the seat and the rest. The great drawback of this chair is that it is potentially unstable in both of its positions. If a person sitting on the chair places his weight on the seat toward the back/-knee rest, the seat can unintentionally tilt toward the back/knee rest with the unfortunate consequence that the seat with the rack will be lifted out of engagement with the rod, so that the back/knee rest falls down, and the seat loses its support. The same risk exists when the chair is in the traditional sitting position with back rest, and the person intends to move the chair and therefore naturally lifts and pulls the front edge of the seat. This can entail that the seat tilts upwardly, and that the transverse rod thereby disengages from the adjusted engagement, following which the back rest swings downwardly.

When the chair has been converted for knee rest use, and the person wants to sit on it, he will initially straddle the knee rest and can hereby unintentionally apply a downward pressure to the seat end most adjacent to the knee rest, so that the seat and thereby the engagement means and the arm are tilted out of the preadjusted knee rest position. This involves the risk of the user sitting down on a seat which is not locked in the angular position and will consequently tilt forwardly, while the knee rest disappears rearwardly. When converting the chair it is moreover necessary to look for the correct adjustment and make sure that the engagement means have really engaged.

The object of the present invention is to provide a convertible chair where seat and back/knee rest in both states of the chair are locked and cannot be released from the state concerned with a person sitting on the chair. Moreover, the chair must be capable of being converted from one state to the other easily and safely with a simple and uncomplicated manipulation and provide great security against wrong operation.

This is achieved with a chair constructed as stated in claim 1. The controlling engagement between the engagement means ensures a well-defined and safe conversion of the chair under all circumstances. The two ends of the guide groove determine the first and second engagement positions so that the user automatically will convert the chair into the correct positions without any problems.

Since the engagement means engage with each other during the entire conversion, the user avoids having to look for the final engagement position, just as also the need for subsequent control of the engagement after conversion is eliminated.

In relation to the previous known chairs, the user will be more inclined to convert from one sitting position to the other as soon as he feelst just a slight need for this, because of the operationally very simple conversion of the chair. This is of great importance ergonomically for the user to obtain the intended advantage of using a knee rest chair.

The users feeling of the chair being simple to operate is additionally improved in that a specific mutual position of the engagement means during the adjustment movements corresponds to a specific swing position of the arm, this giving a clear visual indication of the conversion process.

If the guide groove is given a U-shape with upwardly facing branches, the weight of the rest carrying arm entails that the projection is normally biassed for movement in an upward direction, ensuring that the chair automatically tries to adjust itself to a position of use when being converted.

With the U-shaped guide groove both the seat and the back/knee rest must be lifted for the chair to be converted. A person sitting on the chair cannot unintentionally perform this combined movement, and the chair is therefore completely stable in both of its states.

When initiating the conversion, the user shall moreover activate both the seat and the rest for the projection to be moved down into the bottom of the U-shaped guide grove, and this combined activation movement prevents unintentional conversion of the chair.

With a view to adapting the chair partly to persons of different sizes, partly to one and the same person in the two positions of use, the chair may be adjustable in various manners.

For example, the arm may have two angularly arranged sections which are connected through a fixable pivot link to adjust the distance between the rest and the seat.

With particular view to adjustability to persons of various sizes the length of the arm may be varied in a preferred embodiment, where a first, rest carrying arm section is slidable transversely to a second arm section forming a connection between the first arm section and the support column.

The invention will be described more fully below with reference to the drawing, in which FIG. 1 shows the chair in one state.

Figure 1:
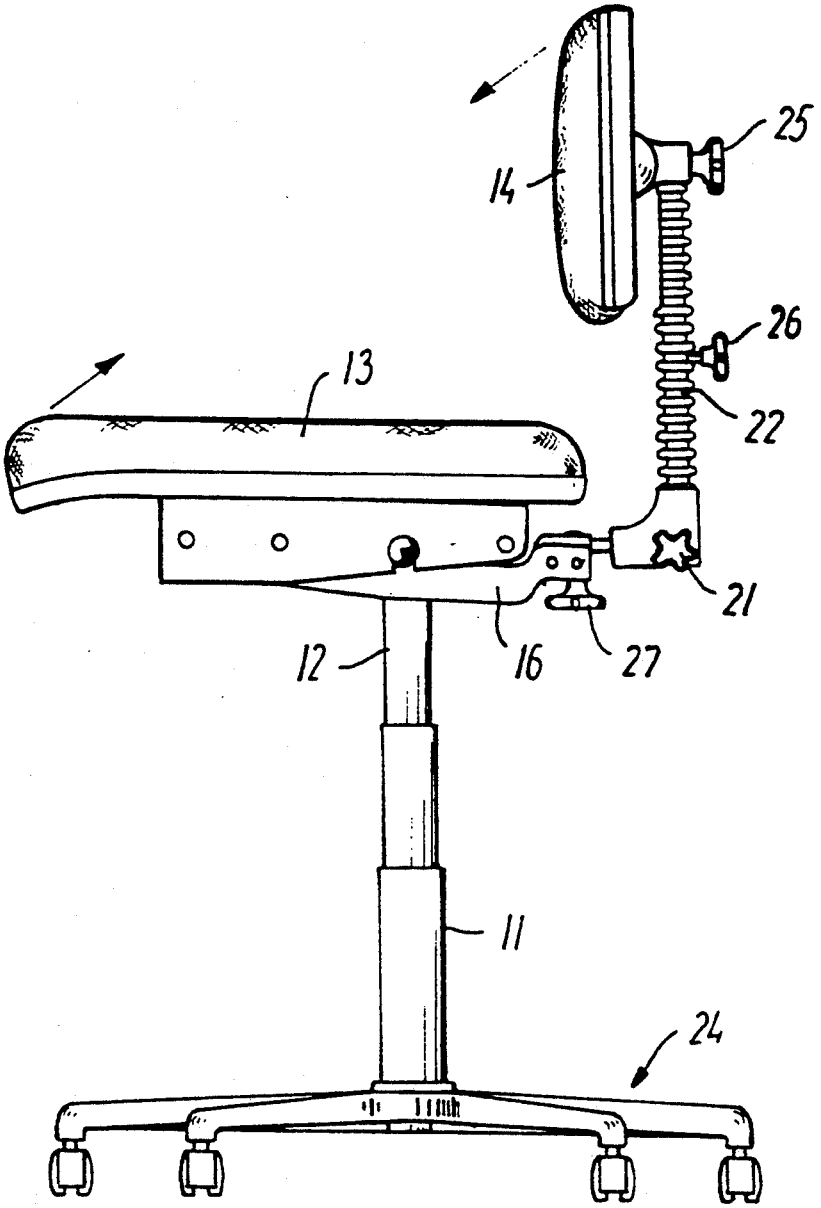
Figure 2:
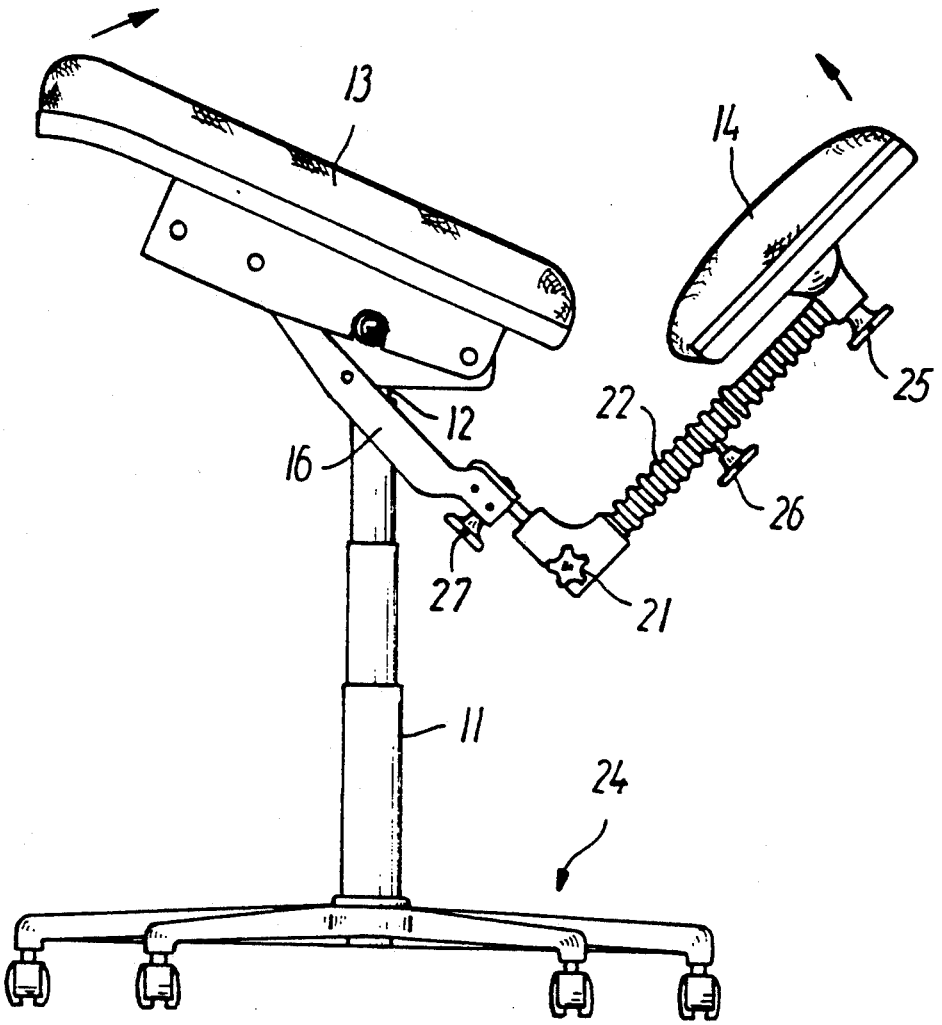
FIG. 2 shows the chair in another state.

It appears from FIGS. 1 and 2 that the chair has a supporting structure consisting of a pipe 11 and a column 12 which is slidable in the pipe 11, so that the chair can be adjusted in height in traditional manner. The pipe 11 is secured in a known manner to a support 24 which rests on the floor. The chair moreover has a seat 13 as well as a rest 14, which serves as a back rest in FIG. 1 showing the chair in one state, and serves as a knee rest in FIG. 2 showing the chair in the other state. The rest 14 is called back/knee rest below and is of a known structure like the seat 13.

Figure 3:
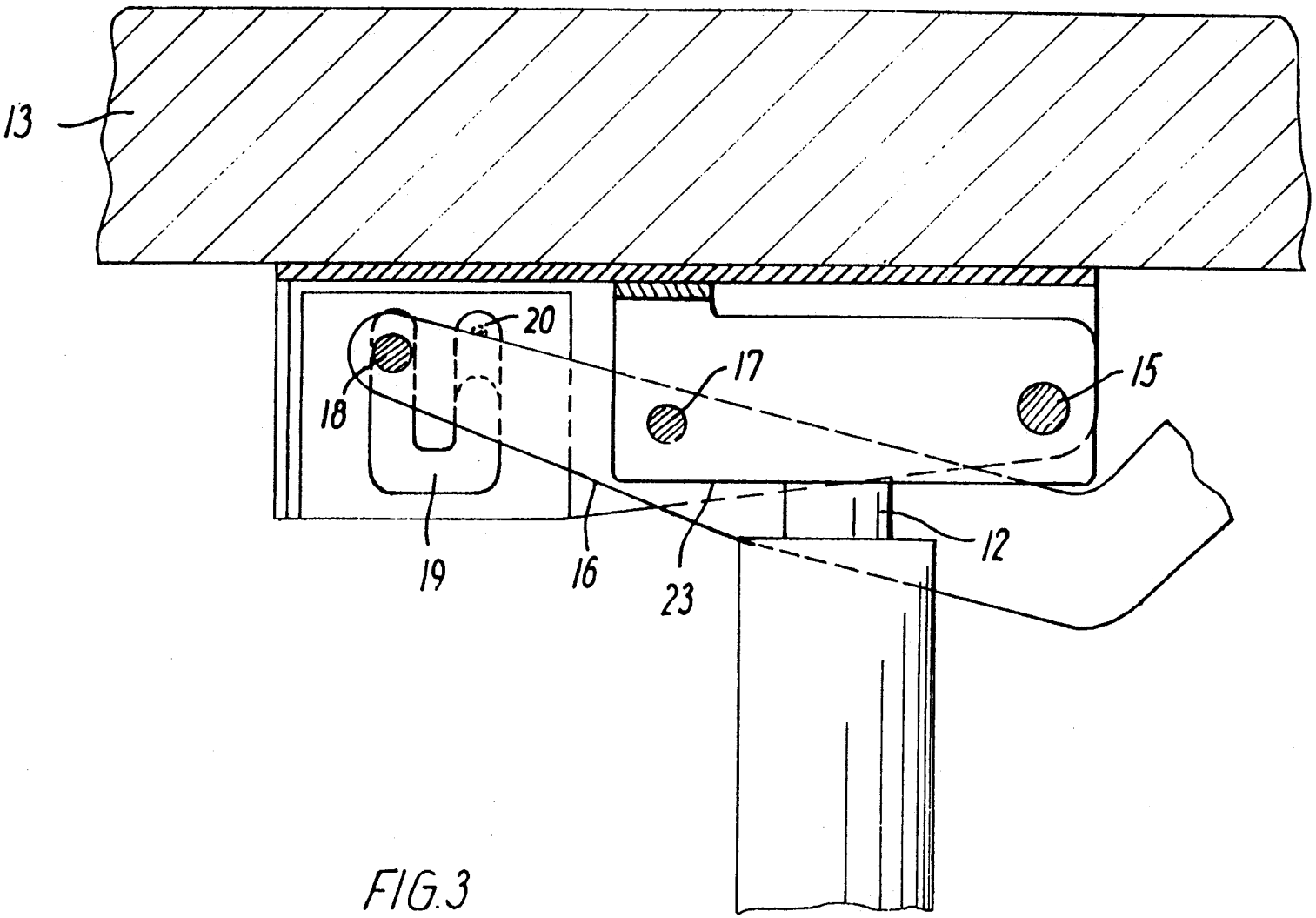
FIG. 3 shows the conversion mechanism of the chair in one state.
Figure 4:
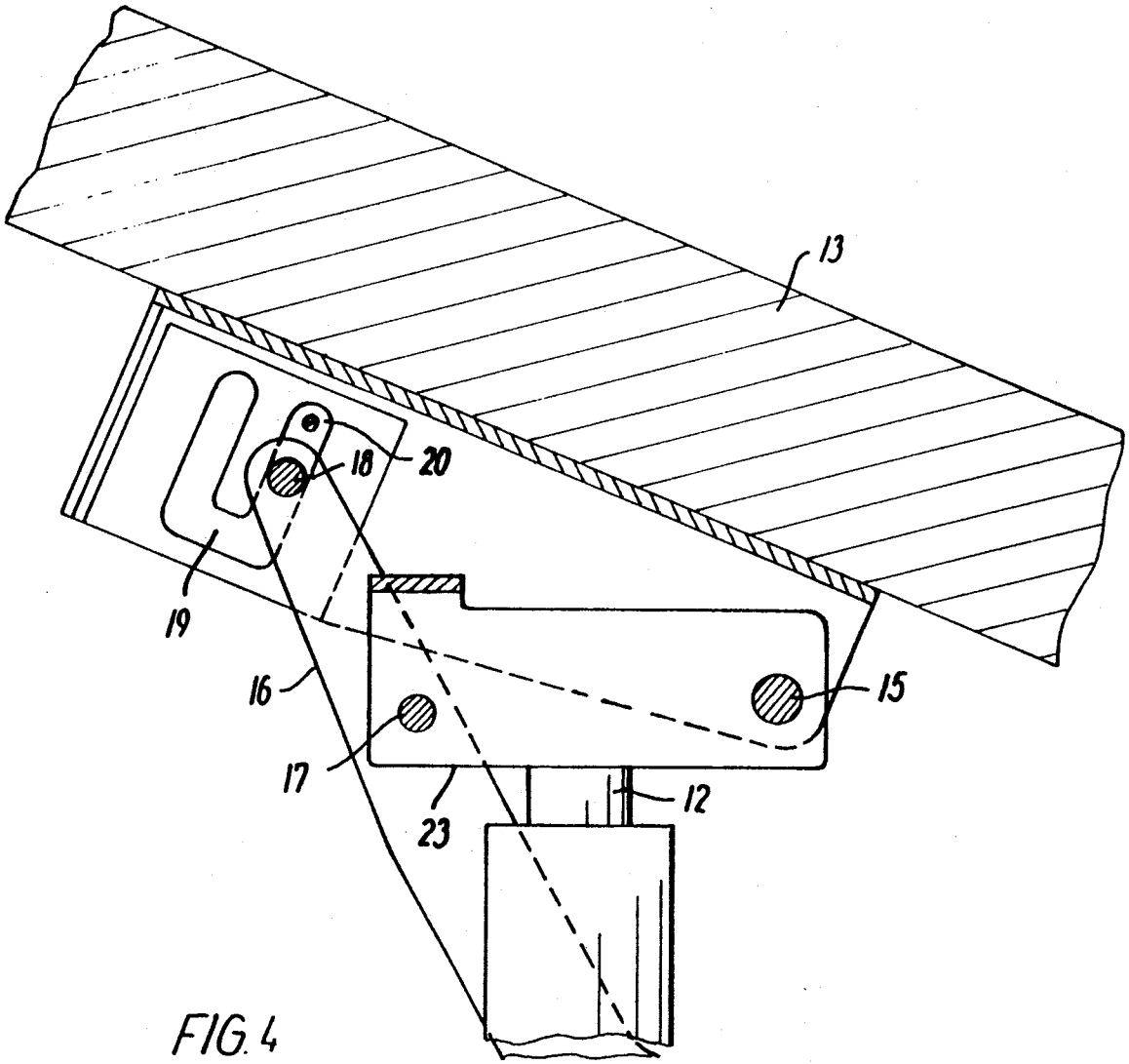
FIG. 4 shows the conversion mechanism of the chair in the other state.

As shown in FIGS. 3 and 4, the column 12 carries a bracket 23, to which the seat 13 is swingably journalled about a horizontal axis 15. A two-armed lever 16 is likewise journalled to the bracket 23 at its horizontal axis of rotation 17. It appears from FIGS. 1 and 2 that the back/knee rest 14 is secured to one end of the two-armed lever 16, and it appears from FIGS. 3 and 4 that the other end of the lever 16 has a transverse shaft 18 which is guided by a U-shaped guide 19 in firm connection with the seat 13. In the shown embodiment, the U-shaped guide 19 has its two guide branches extending tangentially with respect to the axis of rotation 15 of the seat.

The transverse shaft 18 protrudes into or through the U-shaped guide 19, and the movements of the seat 13 and of the two-armed lever 16 are thus coupled to each other.

If the chair is to be converted from the position shown in FIGS. 1 and 3 with back rest 14 and horizontal seat 13 to the state shown in FIGS. 2 and 4 with knee rest 14 and inclined seat 13, this takes place as shown by the arrows in FIG. 1 in that the front edge of the seat and the upper edge of the back/knee rest are pressed towards each other, whereby the automatic locked position is released and conversion can take place. The seat is hereby caused to rotate about the shaft 15, and the U-shaped guide 19 is lifted together with the seat. It will be seen in FIG. 3 that it is necessary also to lift the back rest 14, since only hereby can the shaft 18 be moved freely (i.e. without friction) in the groove 19. When the bottom of the U-shaped guide is thus at the same level as the shaft 18, this shaft can freely move to the right since the two-armed lever 16 can rotate about its shaft 17. The shaft 18 is hereby moved to the other guide branch of the U-shaped guide 19, while the back/knee rest 14 on the other end of the lever is lowered to the position shown in FIG. 2. The seat 13 is then lowered until the shaft 18 abuts the end stop in the right branch of the U-shaped guide 19, as appears from FIG. 4.

If the chair is to be converted again from the state shown in FIGS. 2 and 4 to the state shown in FIGS. 1 and 3, the seat 13 and the knee rest 14 are lifted, and this operation takes place in the opposite order.

It appears from FIGS. 3 and 4 that one of the branches of the U-shaped guide accommodates a block 20 which is to serve as an end stop. A variable end stop is obtained by varying the length of this block 20, so that the mutual position of the seat 13 and the two-armed lever 16 and thereby the rest 14 may be varied.

In the shown embodiment the shaft 18 is arranged on the two-armed lever 16, and the U-shaped guide 19 is firmly connected with the seat 13. However, these might be exchanged with the same result so that a U-shaped guide is arranged on the two-armed lever 16, but with the branches facing downwardly, and such that the transverse shaft 18 is mounted in firm connection with the seat 13.

It appears from FIGS. 3 and 4 that both the front edge of the seat and the back/knee rest are to be lifted for the chair to be converted. A person sitting on the seat 13 in any of the two states of the chair will lock the chair in the state concerned.

It also appears from FIGS. 1 and 2 that the chair has other adjustment possibilities for individual adaptation to the user. A grip 27 permits the arm 22 with the back/knee rest to be displaced longitudinally of the lever 16 and to be fixed in any position. The angular arm 22 can be tilted and fixed with a grip 21 in any angle with respect to the lever 16, and the length of the angular arm 22 may be adjusted and fixed with a grip 26. The back/knee rest 14 may be positioned and fixed in any angular position with respect to the angular arm 22 with a grip 25.

I claim:

1. A convertible chair comprising a lower support structure;

a support column mounted on said support structure;

a seat mounted on said support column;

an arm swingably journalled with respect to said support column;

a back/knee rest mounted on said arm;

a first engagement means mounted on said arm;

a second engagement means fixedly secured to said seat;

said first and second engagement means defining a first preset engagement position in which the back/knee rest is in a back rest position and a second preset engagement position in which the back/knee rest is in a knee rest position;

said first and second engagement means being in controlling engagement with each other during adjustment movements between said first and second engagement positions, whereby conversion of the chair is facilitated.

2. A convertible chair as recited in claim 1, wherein a specific mutual position of said first and said second engagement means during said adjustment movements corresponds to a specific swing position of said arm.

3. A convertible chair as recited in claim 1, wherein said arm has the shape of a two-armed lever whose one arm carries said back/knee rest and whose other arm carries said first engagement means.

4. A convertible chair as recited in claim 1, wherein one of said first and second engagement means comprises a terminated guide groove having two ends; the other of said first and second engagement means comprises a projection protruding into said guide groove;

said two ends of the guide groove each determining one of said first and second engagement positions by acting as a stop for adjusting movements of said projection.

5. A convertible chair as recited in claim 4, wherein said guide groove has a U-shaped with upwardly directed branches.

6. A convertible chair as recited in claim 4, wherein said guide groove has an adjustable end stop determining said second engagement position.

7. A convertible chair as recited in claim 1, wherein said back/knee rest is angularly adjustable with respect to said arm;

said back/knee rest is positioned in a distance from said seat, which distance is adjustable.

8. A convertible chair as recited in claim 7, wherein said arm has two mutually angularly positioned sections which are connected through a fixable pivot link to adjust said distance between said rest and said seat.

9. A convertible chair as recited in claim 1, wherein said arm comprises a first rest-carrying arm section and a second arm section forming the connection between the first arm section and the support column;

said first arm section is slidable longitudinally of said second arm section.

10. A convertible chair comprising a lower support structure;

a support column mounted on said support structure;

a seat swiveling mounted on said support column;

an arm swingably mounted with respect to said support column;

a back/knee rest mounted on said arm;

a first engagement means mounted on said arm;

a second engagement means fixedly secured to said seat;

said first and second engagement means defining a first preset engagement position in which the back/knee rest is in a back rest position and a second preset engagement position in which the back/knee rest is in a knee rest position;

said first and second engagement means being in engagement with each other during adjustment movements between said first and second engagement positions.

11. A convertible chair as recited in claim 10, wherein a specific mutual position of said first and said second engagement means during said adjustment movements corresponds to a specific swing position of said arm.

12. A convertible chair as recited in claim 10, wherein said arm has the shape of a two-armed lever whose one arm carries said back/knee rest and whose other arm carries said first engagement means.

13. A convertible chair as recited in claim 10, wherein one of said first and second engagement means comprises a terminated guide groove having two ends;

the other of said first and second engagement means comprises a projection protruding into said guide groove;

said two ends of the guide groove each determining one of said first and second engagement positions by acting as a step for adjusting movements of said projection.

14. A convertible chair as recited in claim 13, wherein said guide groove has a U-shape with upwardly directed branches.

15. A convertible chair as recited in claim 13, wherein said guide groove has an adjustable end stop determining said second engagement position.

16. A convertible chair as recited in claim 10, wherein said back/knee rest is angularly adjustable with respect to said arm;

said back/knee rest is positioned in a distance from said seat, which distance is adjustable.

17. A convertible chair as recited in claim 16, wherein said arm has two mutually angularly positioned sections which are connected through a fixable pivot link to adjust said distance between said rest and said seat.

18. A convertible chair as recited in claim 10, wherein said arm comprises a first rest-carrying arm section and a second arm section forming the connection between the first arm section and the support column;

said first arm section is slidable longitudinally of said second arm section.

19. A convertible chair as recited in claim 10, wherein said seat is pivotably mounted on said support column.

20. A convertible chair comprising a lower support structure;

a support column mounted on said support structure;

a bracket swiveling mounted on said support column;

a seat pivotally mounted on said bracket, said seat having a bottom;

an arm swingably journalled on said bracket;

a back/knee rest mounted on said arm;

a first engagement means mounted on said arm;

a second engagement means mounted at the bottom of said seat;

said first and second engagement means defining a first preset engagement position in which the back/knee rest is in a back rest position and a second preset engagement position in which the back/knee rest is in a knee rest position;

said first and second engagement means being in controlling engagement with each other during adjustment movements between said first and second engagement positions, whereby conversion of the chair is facilitated.

* * * * *